United States Patent [19]

Kranich, II

[11] Patent Number: 4,644,112

[45] Date of Patent: Feb. 17, 1987

[54] LINEAR TRANSFORMER SWITCH

[75] Inventor: Neil J. Kranich, II, West Allis, Wis.

[73] Assignee: ASEA Electric, Inc., Waukesha, Wis.

[21] Appl. No.: 815,895

[22] Filed: Jan. 3, 1986

[51] Int. Cl.[4] ..... H01H 15/06

[52] U.S. Cl. ..... 200/16 F; 200/153 PA; 200/279; 200/11 TC

[58] Field of Search ..... 200/11 B, 11 TC, 16 B, 200/16 C, 16 D, 16 F, 153 PA, 161, 275, 279, 254, 271–274

[56] References Cited

U.S. PATENT DOCUMENTS

| | | | |
|---|---|---|---|
| 2,064,828 | 12/1936 | Grohsgal | 200/16 F X |
| 3,290,471 | 12/1966 | Gerardin et al. | 200/16 F X |
| 3,673,364 | 6/1972 | Klein | 200/16 F X |
| 3,824,355 | 7/1974 | Norman et al. | 200/16 F |
| 4,504,811 | 3/1985 | Stunzi | 200/16 F |
| 4,562,316 | 12/1985 | Kranich, II | 200/11 TC X |

*Primary Examiner*—J. R. Scott

*Attorney, Agent, or Firm*—Ronald E. Barry

[57] ABSTRACT

A linear transformer switch adaptable for connecting the transformer windings in series-parallel or Delta-Y, the switch including a pair of dielectric plates having a number of sets of fixed contacts mounted in a parallel spaced relation, each contact having flat contact surfaces on each side, a bar mounted between the plates for linear movement, at least one sliding current carrying contact assembly mounted on the bar for each set of fixed contacts, each sliding current carrying contact assembly including a pair of conductive plates of a length sufficient to engage two fixed contacts and a pair of louvered contact sections mounted on each conductive plate, with the sections on one plate opposing the sections on the other plate, and a Geneva drive assembly operatively positioned to move the bar one step in each revolution of the bar and being operable externally of the transformer.

6 Claims, 10 Drawing Figures

LINEAR TRANSFORMER SWITCH

BACKGROUND OF THE INVENTION

In power transformers, series-parallel and Delta-Y switching is done through the use of a reconnectable link board housed inside the transformer tank. This requires service personnel to open one or more manholes in the transformer cover in order to switch the transformer. Opening of the transformer at any time introduces the transformer to a number of perils, such as contamination, trapping of foreign objects in the transformer such as tools, and exposure of the operator to the transformer. It would therefore be desirable to perform such an operation by an externally operated de-energized switch that also provides positive location of the movable contacts with respect to the stationary contacts.

SUMMARY OF THE INVENTION

The switch according to the present invention can be externally operated and positively located in each switch position. The switch includes a plurality of stationary contacts, generally four for series-parallel transformer winding connections and three for each phase of Delta-Y transformer winding connections. Positive engagement of the fixed contacts is provided by louvered contacts provided on sliding current-carrying contacts which are moved linearly between the two operating positions of the switch. The movements of the sliding contacts is accomplished by a Geneva gear indexing system connected to an externally mounted operating handle as disclosed in my copending application Ser. No. 618,265 filed on June 7, 1984, now U.S. Pat. No. 4,562,316, and entitled "High Voltage Linear Tap Changer."

IN THE DRAWINGS

DESCRIPTION OF THE INVENTION

Figure 2:
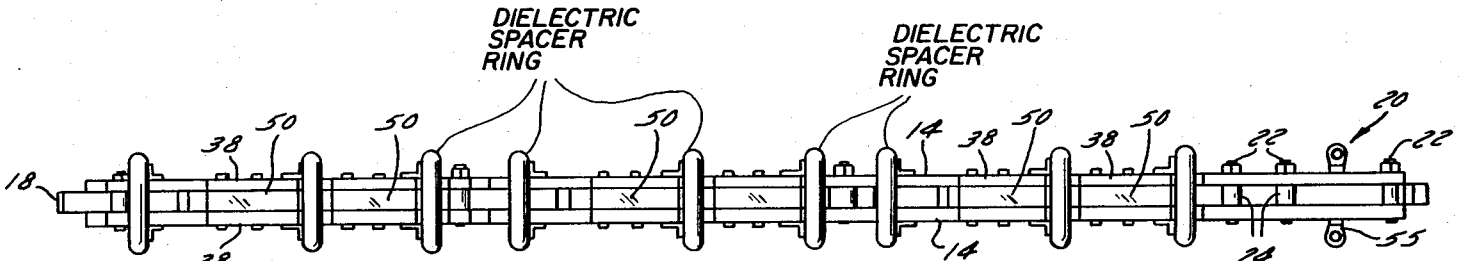
FIG. 2 is a top view of FIG. 1.
Figure 1:
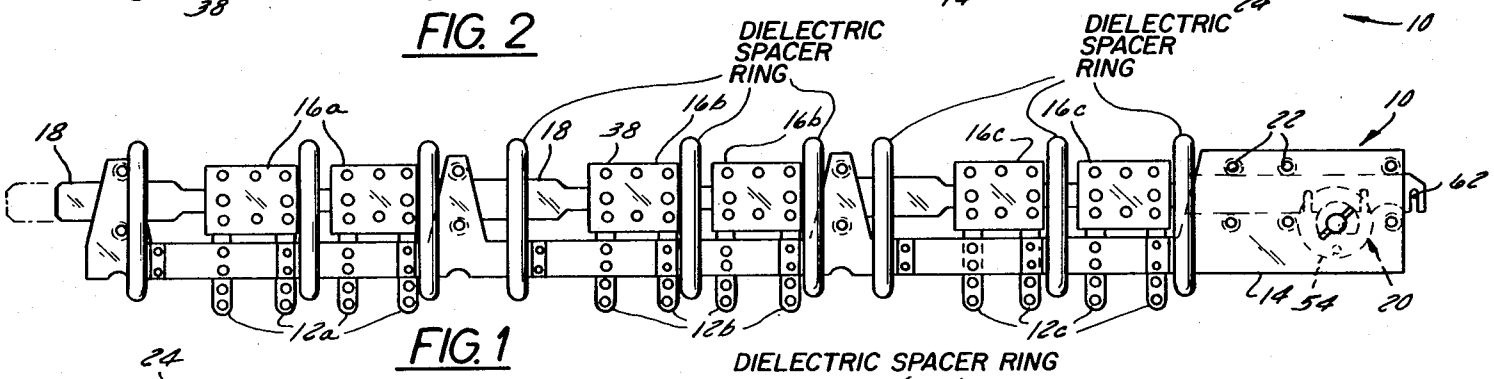
FIG. 1 is a side view of the series parallel transformer switch.

The transformer switch 10, as seen in FIGS. 1 and 2 of the drawings, is of the linear type having three fixed contact assemblies 12*a*, 12*b*, and 12*c*, with each assembly having four fixed contacts 12 for each phase of the transformer windings. The fixed contacts 12 are mounted in a parallel spaced relation between a pair of dielectric plates 14. Interconnection of each contact assembly 12*a*, 12*b* and 12*c* is provided by means of sliding current-carrying assemblies 16*a*, 16*b* and 16*c* mounted on a dielectric slide bar 18. Each contact assembly 16*a*, 16*b* and 16*c*, including two pairs of contacts 16 on the slide bar 18 is indexed between a first position connecting the transformer windings 25 in a parallel relation, FIG. 4 and a second position connecting the transformer windings 25 in a series relation. The slide bar 18 is indexed between the first and second positions by means of a Geneva gear indexing assembly 20 mounted on one end of the plates 14. The transformer switch 10 can be mounted inside of the transformer tank at any convenient location. The switch is operated by means of a handle which extends through the tank wall to engage the Geneva gear drive assembly 20 as shown in my copending application Ser. No. 618,265, now U.S. Pat. No. 4,562,316.

More specifically, the plates 14 are connected in a parallel spaced relation by means of bolts 22 and spaced apart by means of spacers 24. The spacers 24 also act as guides for the bar 18 as described hereinafter. The fixed contacts 12 are formed from a solid copper bar having two mounting holes 26 and two countersunk bores 28. A flat contact surface 30 is provided on each side of the contacts 12 with a curved camming surface 32 on each edge. The contacts 12 are supported between the plates 14 by means of rivets 34 which pass through the openings 26. Washers 36 may be provided to maintain proper spacing. As seen in FIG. 1, the contacts 12 are mounted in groups of four in equally spaced relation with each group of four being connected to one phase of the transformer windings 25. The contacts 12 are connected to the cables 27 by means of crimp connectors 29 which are secured in counter bores 28 by bolts 31.

The sliding contact assemblies 16 each include a pair of copper plates 38 having mounting holes 40 and contact holes 42. Each plate has a pair of louvered contact sections 44 mounted in slots 46 located on the inside face of each of the plates 38 so that the sections 44 face each other. The louvered contact sections may be silver-plated for better conductivity if desired. The louvered contact sections 44 are located a distance apart equal to the distance between the contacts 12 mounted between the plates 14. The sliding contact assemblies 16 are mounted on the bar 18 by means of bolts 48 which pass through the openings 40 in the plates 38 and openings 17 in the bar 18. Electrical communication between the plates 38 is provided by means of electrically conductive bars 50 which are located above and below the bar 18 and between the plates 38. The bars 50 are retained in position by means of bolts 52 which pass through the openings 42 in the plates 38 and openings 43 in the bars 50.

Figure 4:
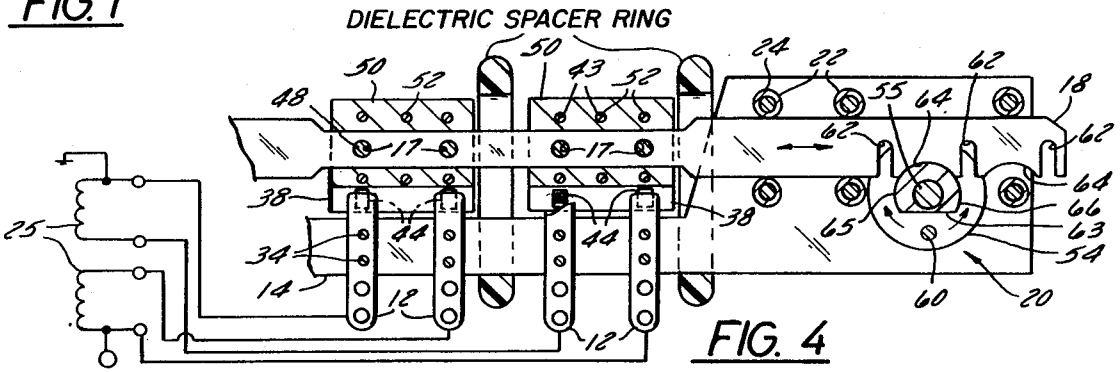
FIG. 4 is an enlarged view of a portion of FIG. 1 showing the Geneva gear indexing assembly.
Figure 3:
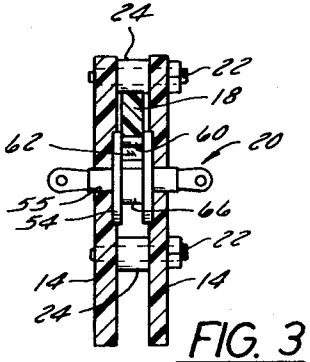
FIG. 3 is an end view of FIG. 1 showing the Geneva gear indexing assembly.
Figure 5:
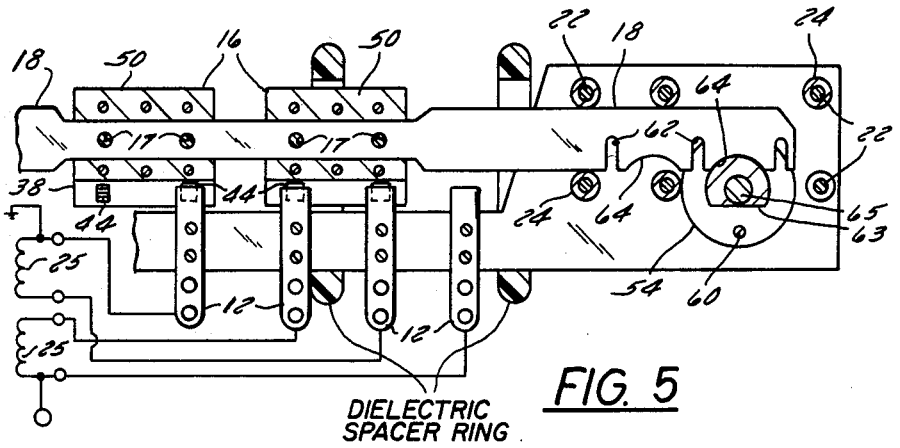
FIG. 5 is a view similar to FIG. 4 showing the windings connected in series.
Figure 8:
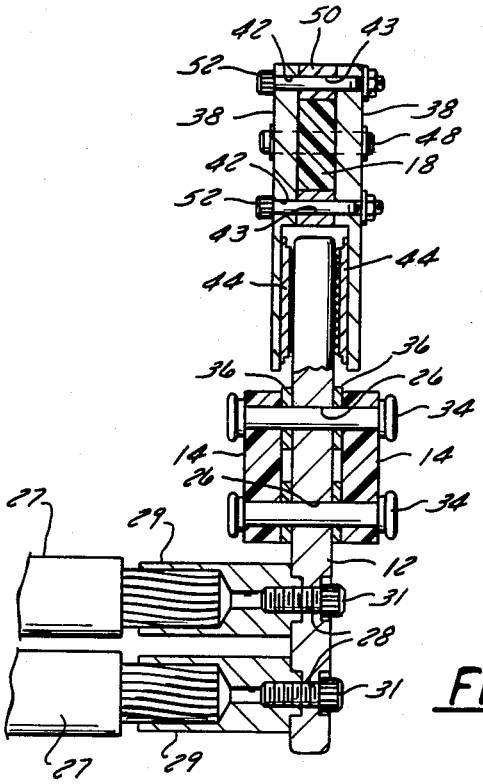
FIG. 8 is a cross-sectional view taken on line 8—8 of FIG. 1 showing the cable connections to the fixed contact.
Figure 9:
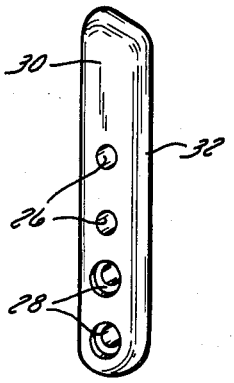
FIG. 9 is a perspective view one of the fixed contacts.
Figure 10:
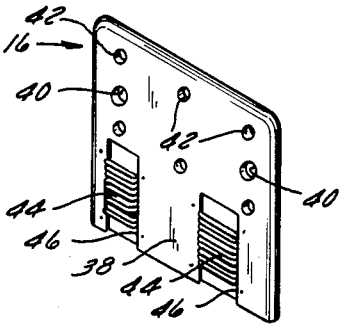
FIG. 10 is a perspective view of one of the sliding current-carrying contact assemblies.

It should be noted in FIG. 8 that the louvered contact sections 44 which face each other are spaced apart a distance slightly smaller than the width of the contacts 12 so that frictional contact is made between the louvered contact sections 44 and the flat surfaces of the bars 12. The contact assemblies 16*a*, 16*b* and 16*c* are spaced apart on the bar 18 so that each pair of contacts 16 engages two of the fixed contacts 12 in each contact assembly 12*a*, 12*b* and 12*c* in the first position (FIG. 4), and one pair of contacts 16 will engage two contacts 12 and the other pair of contacts will engage one contact 12 in the second position (FIG. 5). As seen in FIG. 4, when the bar 18 is in the first position, the transformer windings 25 will be connected in parallel. When the bar 18 is moved to the second position, FIG. 5, the transformer windings 25 will be connected in series.

The bar 18 is moved from the first position to the second position by means of the Geneva drive assembly 20 which includes drive wheel 54 mounted for rotary motion on a shaft 55 between the plates 14. Means are provided on the drive wheel 54 for moving the bar 18 between the first and second positions. Such means is in the form of a drive pin 60 which is rotatable into notches 62 is provided on one edge of the bar 18. In each full revolution of the drive wheel, the drive pin 60 will move into one of the notches 62 during the first half revolution of the wheel and back to the original position in the final rotation of the wheel. Means are provided on the drive wheel for locking or positively locating the bar 18 in each position.

In this regard and referring to FIGS. 4, 5, 6 and 7, such means is the form of a hub 66 provided in the drive wheel 54. It should be noted that the notches 62 in bar 18 are spaced equal distances apart and are separated by an arcuate surface 64. The hub 66 has a curved surface 65 and a flat surface 63. The radius of curvature of the curved surface is equal to the radius of curvature of the arcuate surfaces 64. The hub 66 is used to lock the bar 18 in a fixed position once the bar has been located in electrical communication with the contacts 16. This is accomplished by rotation of the drive wheel 54 until the curved surface 65 on the hub 66 is seated in the arcuate surface 64 on the bar 18. The bar 18 is moved by rotating the pin 60 into engagement with one of the notches 62. As the hub is rotated to seat the pin 60 in notch 62, the flat surface 63 will move out of the arcuate surface 64. Continued rotation of the drive wheel 54 will drive the bar 18 in one direction or the other. The flat surface 63 provided on the hub 66 allows the rod 18 to move when the pin 60 is seated is one of the slots 62.

Figure 6:
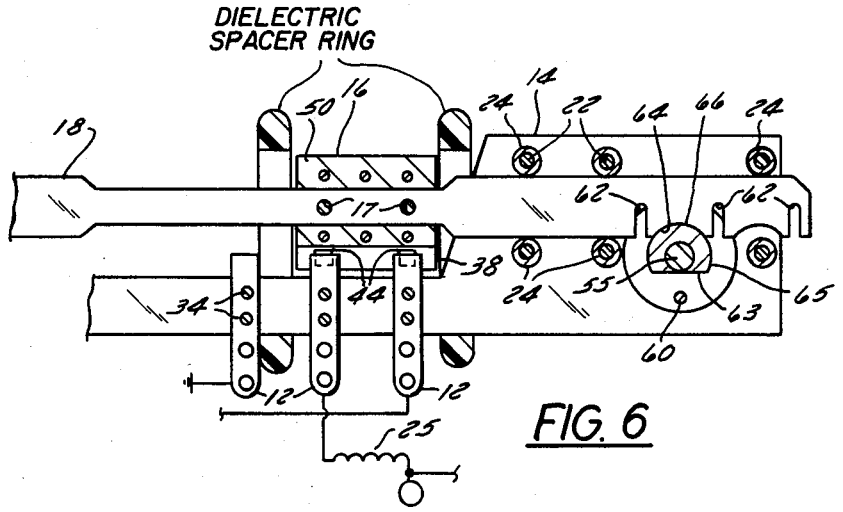
FIG. 6 is a view of a portion of a Delta-Y transformer switch having three fixed contacts with the sliding contact assembly set in a position to connect the windings in Delta.
Figure 7:
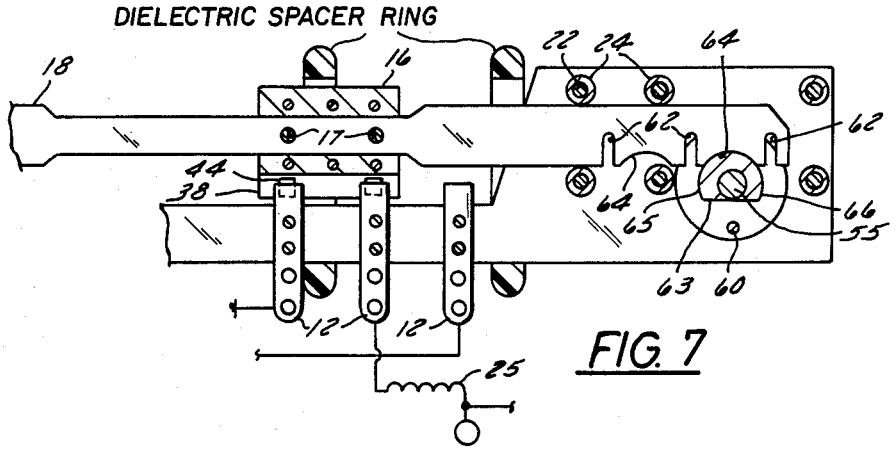
FIG. 7 is a view similar to FIG. 6 with the sliding contact assembly set in a position to connect the windings in Y.

In the alternate embodiment of the invention shown in FIGS. 6 and 7, a Delta-Y transformer switch 10 is shown in which three contacts 12 are provided for each phase of the transformer windings. A single sliding contact assembly 16 is mounted on the bar 18 for movement into engagement with each set of three contacts 12. In this regard, each of the contacts 12 have the same general configuration and are mounted at equally spaced intervals. The center or first contact in each set of three contacts is connected to one end of the winding 25. The second contact is connected to ground and the third contact is connected to the other end of the next winding. When the sliding contact assembly 16 is in the position shown in FIG. 6, with the louvered sections 44 in contact with the first and third contacts 12, the winding will be connected in Delta. When the contact assembly 16 is in the position shown in FIG. 7, with the lowered contacts 44 in engagement with the first and second contacts, the windings 25 will be connected in Y.

The embodiments of the invention in which an exclusive property of privilege is claimed, are defined as follows:

1. A linear series-parallel transformer switch comprising a pair of dielectric plates mounted in a parallel spaced relation, a number of sets of fixed contacts supported in the space between said dielectric plates, each set of fixed contacts, including four contacts mounted in an equally spaced relation, a bar supported for reciprocal motion between said ribs, a number of sets of current-carrying contact assemblies mounted on said bar, each set of assemblies including two pair of sliding contacts for each set of fixed contacts, each pair including two conductive plates spaced apart a distance less than the thickness of said fixed contacts and having a length sufficient to interconnect two fixed contacts, louvered contact means mounted on each of said contact plates in an opposing relation and being spaced apart a distance less than the thickness of said fixed contacts, and means for moving said bar between a first position wherein each pair of plates interconnects two fixed contacts and a second position wherein one pair of plates interconnects two fixed contacts and the other pair is connected to one fixed contact.

2. The switch according to claim 1 wherein each of said fixed contacts has a flat contact surface on each side and said louvered contact means comprises a pair of louvered sections on each plate mounted in an opposing relation to the louvered sections on the other plate.

3. The switch according to claim 2 wherein said moving means includes a number of slots spaced equal distances apart on said bar and a Geneva drive wheel having a pin positioned to engage one slot in each revolution of the drive wheel.

4. A linear Delta-Y transformer switch comprising a pair of dielectric plates mounted in a parallel spaced relation, a number of sets of three fixed current-carrying contacts supported in the space between said dielectric plates, a bar supported for reciprocal motion between said ribs, a current-carrying contact assembly mounted on said bar for each set of three fixed contacts, each of said assemblies including a pair of conductive plates spaced apart a distance less than the thickness of said fixed contacts and having a length sufficient to interconnect two fixed contacts, louvered contact means mounted on each of said conductive plates in an opposing relation and being spaced apart a distance less than the thickness of said fixed contacts, and means for moving said bar between first position wherein said assembly interconnects two of said three contacts and a second position wherein said assemby interconnects one of said first two contacts with the third contact.

5. The switch according to claim 4 wherein each of said fixed contacts has a flat contact surface on each side and said louvered contact means comprises a pair of louvered contact sections on each plate mounted in an opposing relation to the louvered sections on the other plate.

6. The switch according to claim 5 where said moving means includes a number of slots spaced equal distances apart on said bar and a Geneva drive wheel having a pin positioned to engage one slot in each revolution of the drive wheel.

* * * * *